US006766915B2

(12) United States Patent
Wu

(10) Patent No.: US 6,766,915 B2
(45) Date of Patent: Jul. 27, 2004

(54) DRINK CONTAINER FOR SMALL CHILDREN

(76) Inventor: Ming-Feng Wu, No. 122, Chien Ping 5th Street, Tainan (TW)

( * ) Notice: Subject to any disclaimer, the term of this patent is extended or adjusted under 35 U.S.C. 154(b) by 0 days.

(21) Appl. No.: 10/322,546

(22) Filed: Dec. 19, 2002

(65) Prior Publication Data

US 2004/0118858 A1 Jun. 24, 2004

(51) Int. Cl.[7] ..... A61J 9/00
(52) U.S. Cl. ..... 215/11.4; 220/714; 220/705
(58) Field of Search ..... 215/11.4, 389; 222/212, 490, 494; 220/705, 714

(56) References Cited

U.S. PATENT DOCUMENTS 4,135,513 A * 1/1979 Arisland ..... 215/11.4
4,749,108 A * 6/1988 Dornsbusch et al. ..... 222/212
5,553,726 A * 9/1996 Park ..... 215/11.4

* cited by examiner

*Primary Examiner*—Kien Nguyen
(74) *Attorney, Agent, or Firm*—Rosenberg, Klein & Lee

(57) ABSTRACT

A drink container for small children includes a container, a lid joined to an upper opening of the container, and a drip prevention element. The lid has a sucking portion for allowing a young child, to suck on to draw out drink contents of the container with the mouth. The lid is formed with a passage for allowing drink contents of the container to pass through. The drip prevention element is arranged in a passage of the lid to block the passage when there is no external sucking force exerted on the sucking portion, and which can bend to effect opening of the passage when there is external sucking force exerted on the sucking portion. Thus, liquid contents can't drip through the lid when a young child is learning to grasp objects with the drink container.

5 Claims, 4 Drawing Sheets

DRINK CONTAINER FOR SMALL CHILDREN

BACKGROUND OF THE INVENTION

1. Field of the Invention

The present invention relates to a drink container for small children, more particularly a drink container, which is provided for training and feeding small children, and which is structured so that liquid contents thereof can't drip when it is laid down or inverted.

2. Brief Description of the Prior Art

There are drink containers especially designed for small children and capable of being used for training small children to grasp objects. Because small children still can't hold a cup firmly for an extended period of time, such drink containers for small children are usually made of breakage-resistant materials so that they won't break if they fall down onto the ground.

Referring to FIGS. 4, and 5, European Patent No. EP0635922B1 discloses a learner drinking vessel, which includes a container 4, and a lid 41 joined to the upper end of the container 4. The lid 41 has a spout 411 in fluid communication with the container 4. A valve member 42 is disposed under the lid 41, and has a drip-prevention aperture 421 formed thereon to be in communication with the spout 411. When small children suck on the spout 411, liquid contents of the vessel are forced to flow through the drip-prevention aperture 421 into the children's mouths. When small children play with the learning drinking vessel, and hold the same in various positions, e.g. an inverted one, liquid contents of the vessel can't drip through the drip-prevention aperture 421. Furthermore, the drinking vessel is made of breakage-resistant materials, e.g. PP, so that it can't break if it falls down or hits other objects. Therefore, the drinking vessel is safe to use, and has relatively long service life, having relatively few disadvantages. However, this type of learner drinking vessel has been made available in the market for many years, and there are not many different drinking vessels for young children provided to consumers as other options.

SUMMARY OF THE INVENTION

It is a main object of the present invention to provide a drink container for small children, which is structured so that liquid contents thereof can't drip when it is laid down or inverted.

The drink container for small children includes a containing body for containing drinks therein, a lid joined to an upper opening of the containing body, and a drip prevention element. The lid has a sucking portion for allowing a user, especially a young child user, to suck on to draw out drink contents of the containing body with the mouth. The lid is formed with a passage for allowing drink contents of the containing body to pass through. The drip prevention element has a valve portion, which is arranged in a passage of the lid to sealingly contact an inner side of the lid to block the passage when there is no external sucking force exerted on the sucking portion, and which can bend to effect opening of the passage when there is external sucking force exerted on the sucking portion.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
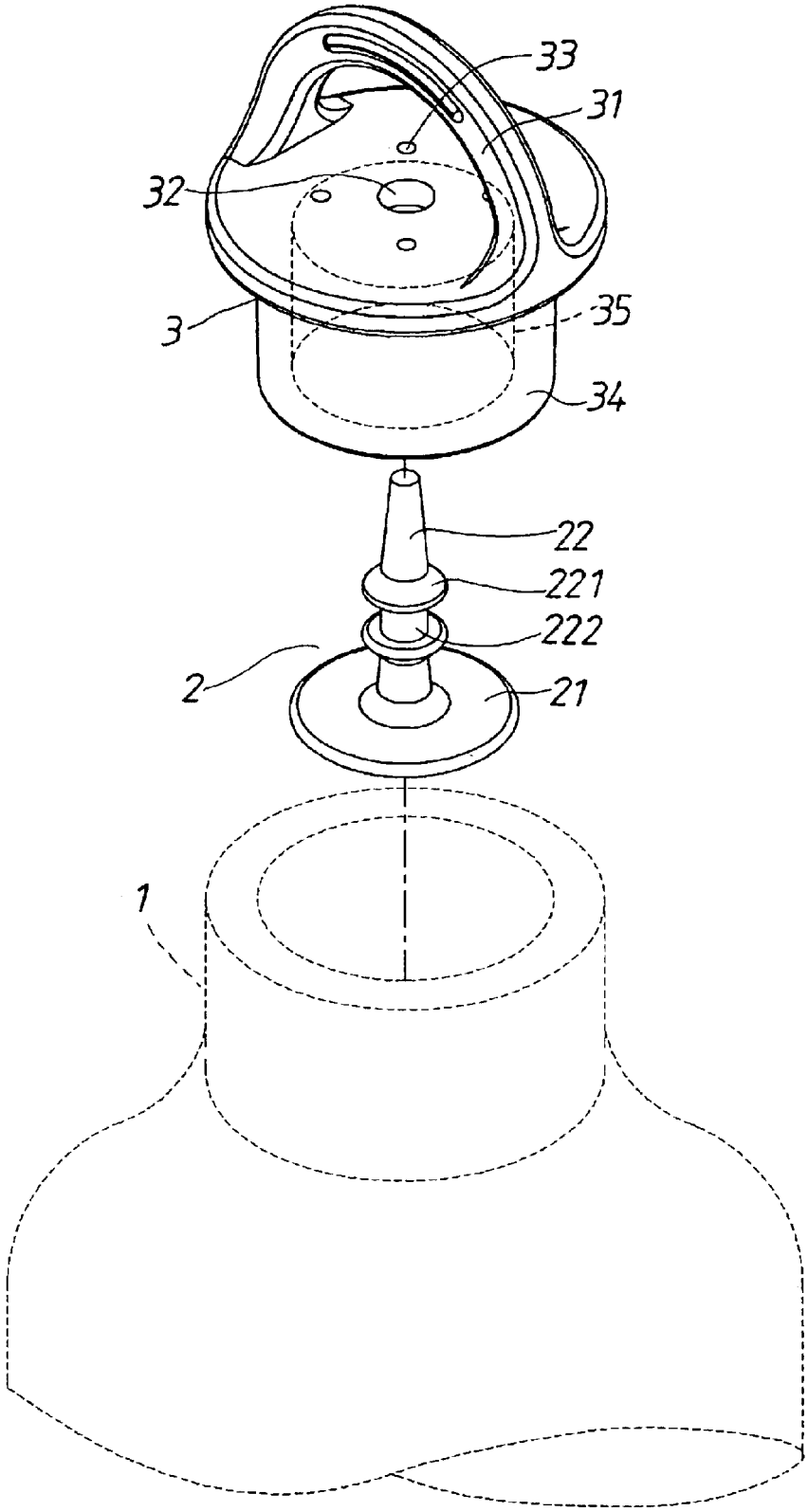
FIG. 1 is an exploded perspective view of the drink container for small children according to the present invention.

Referring to FIG. 1, a drink container for small children according to the present invention includes a containing body 1, a drip prevention element 2, and a lid 3. The containing body 1 is make of breakage-resistant materials, and is provided for containing drinks. The lid 3 is joined to the upper end of the containing body 1. The lid 3 includes a sucking portion 31, and a connecting portion 34 projecting from a lower side of the sucking portion 31. There are a central through hole 32, and several outlets 33 formed on the sucking portion 31. There is a central hole 35 formed in the connecting portion 34, and communicating with the central through hole 32 and the outlets 33 of the lid 3.

The drip prevention element 2 is made of silicon rubber or other rubber materials so that it has flexibility and original shape thereof can be restored when external force exerted on it disappears. The drip prevention element 2 includes a sloping valve portion 21, and a post portion 22, which sticks up from an upper side of the valve portion 21 so that the drip prevention element 2 is substantially shaped like a "T". There are two separate annular protrusions 221 formed on the post portion 22, and there is an annular recess 222 formed between the annular protrusions 221. The diameter of the valve portion 21 is slightly bigger than that of the central hole 35 of the connecting portion 34 of the lid 3 so that the valve portion 21 can fit sealingly in the lid 3.

In combination, the drip prevention element 2 is inserted into the central hole 35 of the connecting portion 34 of the lid 3, and the post portion 22 is passed through the central through hole 32 of the sucking portion 31 of the lid 3 with the annular protrusions 221 being arranged on two sides of the sucking portions 31, i.e. the annular recess 222 of the post portion 22 is fitted in the central through hole 32. Then, the lid 3 is joined to an upper opening of the containing body 1 at the connecting portion 34. Furthermore, the valve portion 21 is formed such that a line normal to it can be parallel to a central axis of the central hole 35 of the connecting portion 34 of the lid 3 or not.

Figure 2:
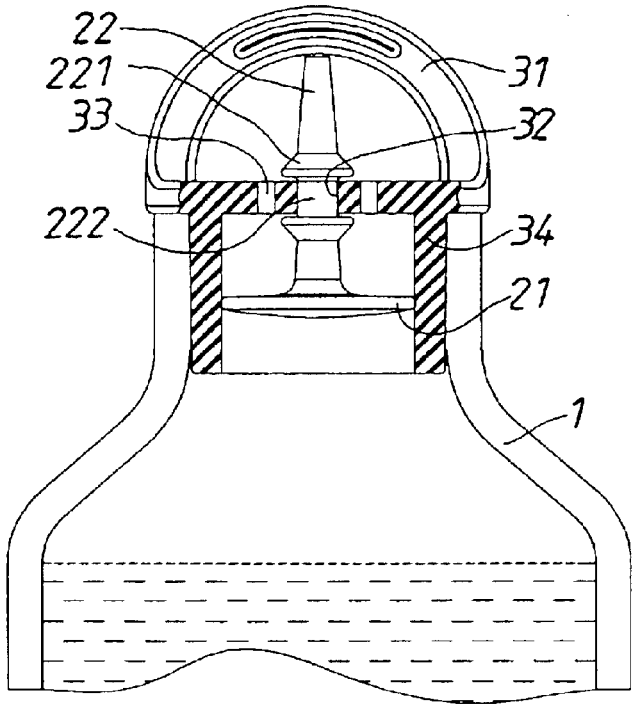
FIG. 2 is a partial cross-sectional view of the drink container for small children according to the present invention.
Figure 3:
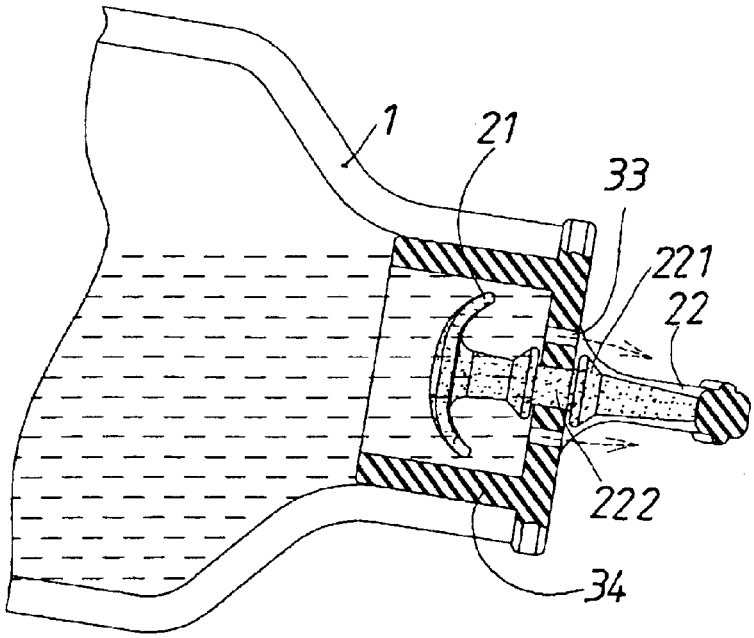
FIG. 3 is a cross-sectional view of the drink container for small children according to the present invention, while being used.
Figure 4:
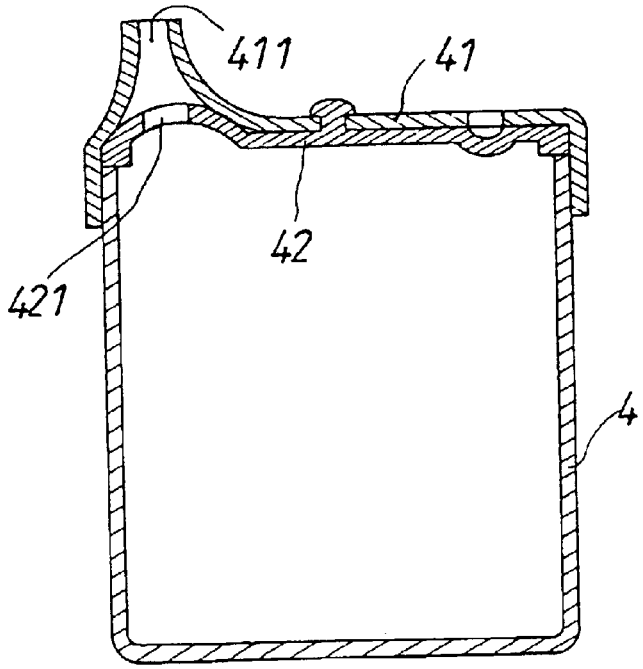
FIG. 4 (PRIOR ART)
FIG. 4 is a horizontal cross-sectional view of the drink container for small children according to the present invention.
Figure 5:
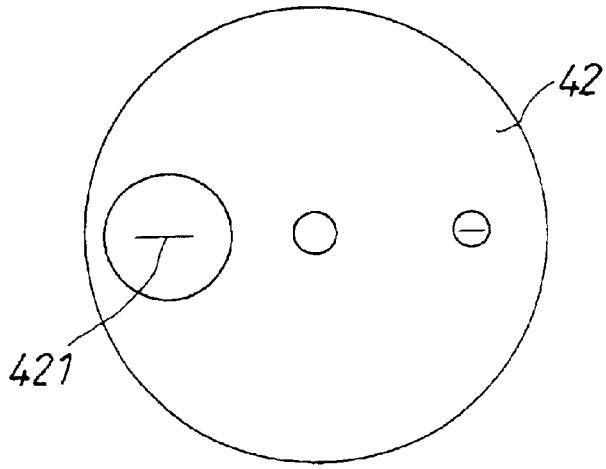
FIG. 5 (PRIOR ART)
FIG. 5 is a horizontal cross-sectional view of the drink container for small children according to the present invention, while the user stops sucking.
Figure 6:
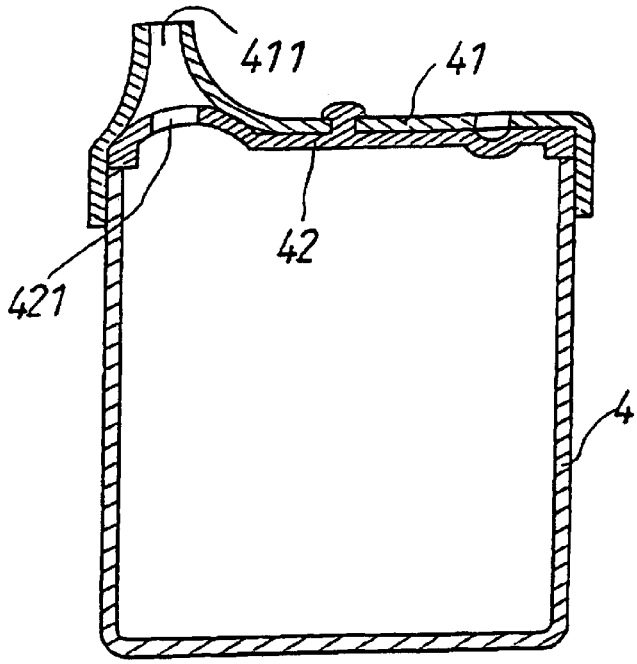
FIG. 6 (PRIOR ART)
FIG. 6 is a cross-sectional view of the conventional drinking vessel as disclosed in European Patent No. EP0635922B1; and, FIG. 7 is a top view of the conventional drinking vessel as disclosed in European Patent No. EP0635922B1.
Figure 7:
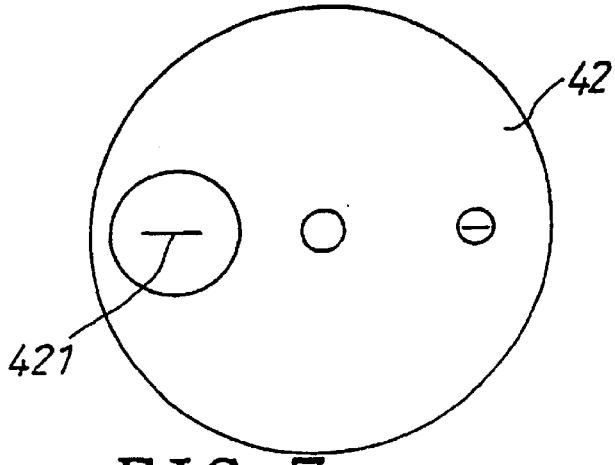
FIG. 7 (PRIOR ART)
Figure 1:
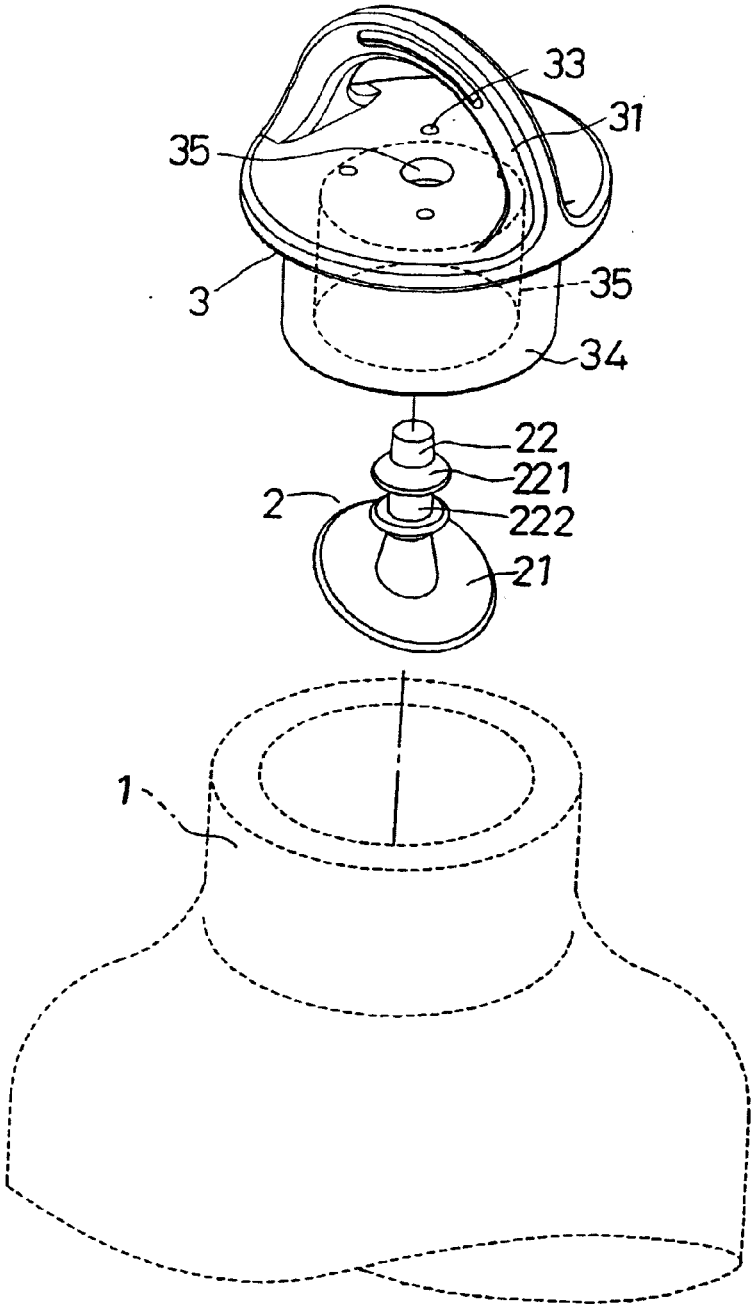
Figure 2:
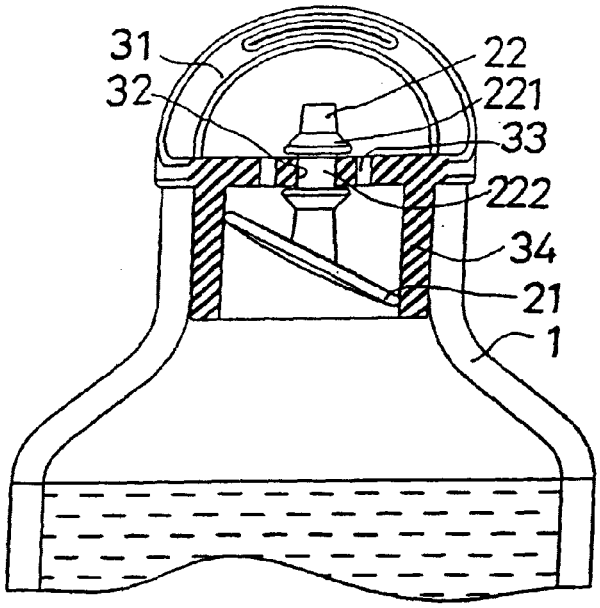
Figure 3:
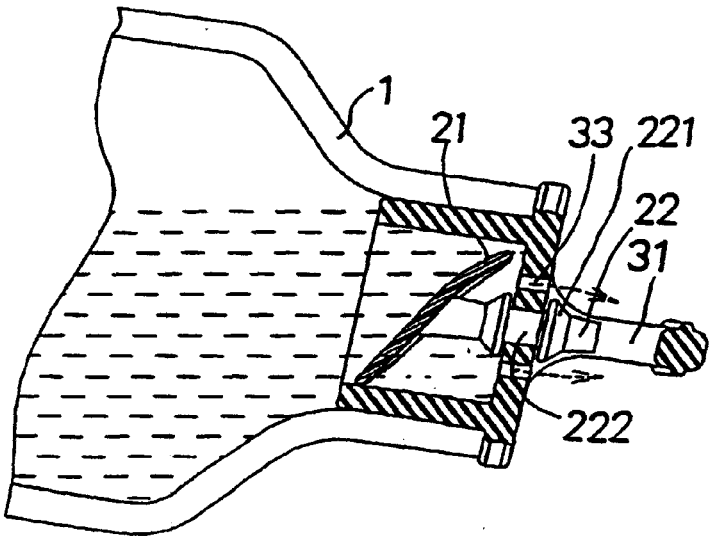
Figure 4:
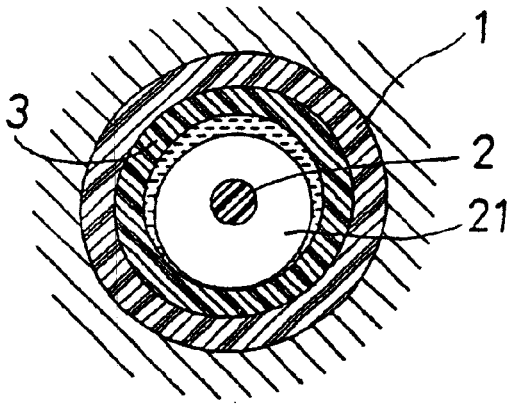
Figure 5:
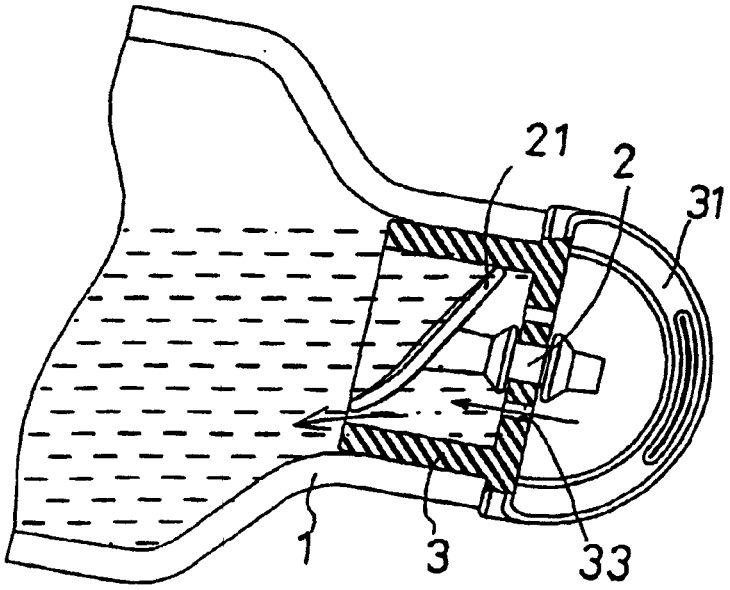
Figure 6:
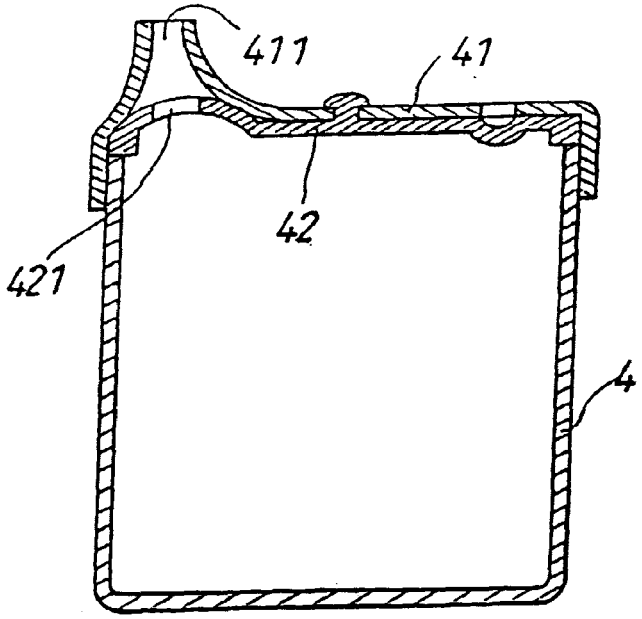
FIG. 6 (PRIOR ART)
Figure 7:
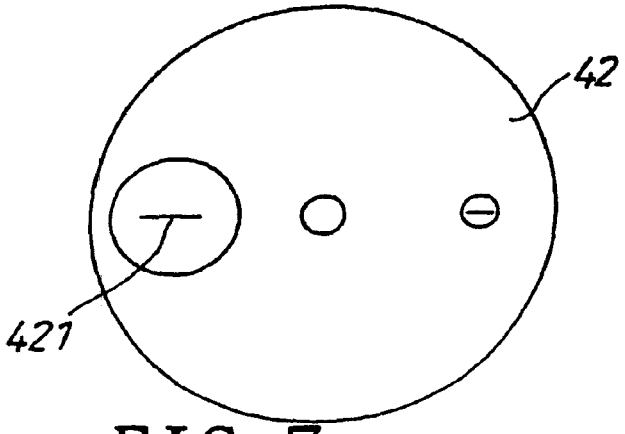
FIG. 7 (PRIOR ART)

Referring to FIG. 2, drink is contained in the containing body 1. When a young child user sucks on the sucking portion 31 of the lid 3 with the lip covering the holes 32 and 33, a negative pressure will be formed in the sucking portion 31, causing an edge of the valve portion 21 to bend towards the sucking portion 31, as shown in FIGS. 3 and 4. Thus, a space comes into existence between the valve portion 21 and the connecting portion 34 of the lid 3, and liquid contents of the containing body 1 can flow into the user's mouth via the through holes 32, 34, and the outlets 33 of the lid 3.

Relatively low pressure will be caused in the containing body 1 by the sucking force. When the user stops sucking on the sucking portion 31, liquid between both the valve portion 21 and the connecting portion 34 will be forced to move back into the containing body 1 due to the relatively low pressure in the containing body 1, and the valve portion 21 will move back to the original shape to sealingly contact the inner side of the containing portion 34 of the lid 3, as shown in FIG. 2. Thus, when small children are learning to grasp objects with the present drink container, and move the same to various positions such as inverted one and a laid-down one, liquid contents of the containing body 1 can't drip through the lid 3.

From the above description, it can be understood that the drink container for small children according to the present invention can be used as an ordinary drinking vessel as well as a kit for young children to learn to grasp objects with. And, the drip prevention element 2 can prevent drink contents of the containing body 1 from dripping out through the lid 3 when a child is learning to grasp objects with the present drink container, and moving the same to even and inverted position. And, liquid will not be left above the valve portion 21 to flow out because when a child stops sucking on the sucking portion 31, liquid between both the valve portion 21 and the connecting portion 34 will be forced back into the containing body 1 by the relatively low pressure in the containing body 1.

What is claimed is:

1. A drink container for small children, comprising:

a containing body for containing drinks therein;

a lid joined to an upper opening of the containing body; the lid having a sucking portion for allowing a user to suck on to draw out drink contents of the containing body with a mouth of the user; the lid is formed with a passage for allowing drink contents of the containing body to pass through; and, a drip prevention element; the drip prevention element having a valve portion, which is arranged in sloped manner transversely across a passage of the lid to sealingly contact an inner side of the lid to block the passage when there is no external sucking force exerted on the sucking portion, and which can bend to effect opening of the passage when there is external sucking force exerted on the sucking portion; when external sucking force on the sucking portion is removed, liquid between both the valve portion and the passage of the lid being capable of moving back into the containing body due to a relatively low pressure caused by the external sucking force in the containing body.

2. A drink container for small children, comprising:

a containing body for containing drinks therein;

a lid joined to an upper opening of the containing body; the lid having a sucking portion for allowing a user to suck on to draw out drink contents of the containing body with a mouth of the user, the lid is formed with a passage for allowing drink contents of the containing body to pass through; and, a drip prevention element; the drip prevention element having a valve portion, which is arranged in a passage of the lid to sealingly contact an inner side of the lid to block the passage when there is no external sucking force exerted on the sucking portion, and which can bend to effect opening of the passage when there is external sucking force exerted on the sucking portion; when external sucking force on the sucking portion is removed, liquid between both the valve portion and the passage of the lid being capable of moving back into the containing body due to a relatively low pressure caused by the external sucking force in the containing body;

wherein the lid has a connecting portion projecting from a lower side of the sucking portion, and the sucking portion includes a through hole, and a plurality of outlets around the through hole in communication with a central hole of the connecting portion; the through holes, the outlets, and the central hole together forming the passage of the lid; the valve portion being arranged in the central hole of the connecting portion to openably block the passage of the lid.

3. The drink container for small children as claimed in claim 2, wherein the drip prevention element has a post portion sticking up from an upper side of the valve portion thereof, and an annular recess on the post portion, which are passed through the through hole of the sucking portion of the lid, and fitted into the through hole respectively for the drip prevention element to be joined to the lid.

4. The drink container for small children as claimed in claim 3, wherein the drip prevention element is made of rubber materials, and a diameter of the valve portion is at least slightly bigger than that of the central hole of the connecting portion of the lid.

5. The drink container for small children as claimed in claim 3, wherein the valve portion is formed so as to slope with respect to the sucking portion of the lid when there is no external sucking force being applied on it.

* * * * *

UNITED STATES PATENT AND TRADEMARK OFFICE

CERTIFICATE OF CORRECTION

PATENT NO. : 6,766,915 B2
DATED : July 27, 2004
INVENTOR(S) : Ming-Feng Wu

It is certified that error appears in the above-identified patent and that said Letters Patent is hereby corrected as shown below:

Drawings,
Please cancel the drawings Figs. 1-7 and replace with the attached Figs. 1-7.

Signed and Sealed this

Twenty-ninth Day of November, 2005

JON W. DUDAS
*Director of the United States Patent and Trademark Office*